US011454057B2

(12) United States Patent
Veeneman et al.

(10) Patent No.: US 11,454,057 B2
(45) Date of Patent: Sep. 27, 2022

(54) HINGE AND CABINET PROVIDED WITH A HINGE

(71) Applicant: POLYPLASTIC GROUP B.V., Rotterdam (NL)

(72) Inventors: Jan Peter Veeneman, Bergschenhoek (NL); Kenzie Van Der Klooster, HW Zevenhuizen (NL)

(73) Assignee: POLYPLASTIC GROUP B.V., Rotterdam (NL)

( * ) Notice: Subject to any disclaimer, the term of this patent is extended or adjusted under 35 U.S.C. 154(b) by 0 days.

(21) Appl. No.: 16/762,358

(22) PCT Filed: Nov. 7, 2018

(86) PCT No.: PCT/NL2018/050743
§ 371 (c)(1),
(2) Date: May 7, 2020

(87) PCT Pub. No.: WO2019/093887
PCT Pub. Date: May 16, 2019

(65) Prior Publication Data

US 2020/0270922 A1 Aug. 27, 2020

(30) Foreign Application Priority Data

Nov. 7, 2017 (NL) ..... 2019859

(51) Int. Cl.
*E05D 7/04* (2006.01)
*E05D 11/00* (2006.01)
(Continued)

(52) U.S. Cl.
CPC ..... *E05D 11/0054* (2013.01); *E05D 5/0246* (2013.01); *E05D 7/081* (2013.01);
(Continued)

(58) Field of Classification Search
CPC . Y10T 16/539; Y10T 16/5398; Y10T 16/534; Y10T 16/524; Y10T 16/53988;
(Continued)

(56) References Cited

U.S. PATENT DOCUMENTS 1,374,437 A * 4/1921 Coombs ..... E05F 1/066 16/313
1,691,759 A * 11/1928 Fischer ..... E05F 1/066 16/314
(Continued)

FOREIGN PATENT DOCUMENTS

DE 19 52 411 A1 5/1971
DE 19745189 A1 * 4/1999 ..... E05D 7/081
(Continued)

*Primary Examiner* — Chuck Y Mah
(74) *Attorney, Agent, or Firm* — Perry + Currier Inc.

(57) ABSTRACT

A furnishing is fitted with a rotating panel (5), in particular a transparent panel. The panel is mounted in the furnishing via at least a hinge (20), wherein the hinge comprises a first hinge part (21) for attaching close to the panel and a second hinge part (22) for attaching to the panel. A receivable member (25) extends from one of the two hinge parts (21,22) and is received in a receiving cavity (35) in another of the two hinge parts in order to connect the two hinge parts pivotally to each other. The respective other hinge part (22) comprises a holder part (30) with a holder body (33) which is accommodated while allowing freedom of movement in the receiving cavity. The holder body (33) comprises a bore in which the receiving member is received.

14 Claims, 2 Drawing Sheets

(51) Int. Cl.
*E05D 5/02* (2006.01)
*E05D 7/081* (2006.01)

(52) U.S. Cl.
CPC ... *E05Y 2201/636* (2013.01); *E05Y 2600/502* (2013.01); *E05Y 2800/404* (2013.01); *E05Y 2800/672* (2013.01); *E05Y 2900/202* (2013.01)

(58) Field of Classification Search
CPC .. F25D 23/028; F25D 23/04; F25D 2323/024; F25D 11/00; F25D 25/025; E05Y 2900/31; E05Y 2201/638; E05Y 2201/636; E05Y 2900/102; E05Y 2600/502; E05D 3/02; E05D 5/125; E05D 5/14; E05D 7/081; E05D 7/0027; E05D 11/0054; E05D 5/0246; E05F 1/043; E05F 1/1207; E05F 1/063
See application file for complete search history.

(56) References Cited

U.S. PATENT DOCUMENTS 3,349,429 A * 10/1967 Suska ..... E05D 3/02 16/275
3,832,755 A * 9/1974 Maertin ..... E05D 5/10 16/309
4,100,646 A * 7/1978 Schubeis ..... E05F 1/066 16/309
4,391,020 A * 7/1983 Hsu ..... E05F 1/066 16/314
5,249,334 A * 10/1993 Horberg ..... E05D 5/121 16/224
5,263,227 A * 11/1993 Hrbek ..... E05D 5/121 16/224
5,265,311 A * 11/1993 Gard ..... E05F 1/06 16/311
7,013,531 B2 * 3/2006 Jackson ..... E05F 1/063 16/309
9,500,014 B2 * 11/2016 Nielsen ..... E05D 11/04
2006/0225361 A1 * 10/2006 Scheer ..... E05D 11/04 49/397
2008/0083087 A1 * 4/2008 Lin ..... E05D 11/1064 16/252
2013/0249372 A1 * 9/2013 Lively ..... E05D 7/04 312/405
2013/0270988 A1 * 10/2013 Nicholson ..... A47B 96/00 312/400
2014/0259529 A1 * 9/2014 Jenkinson ..... E05D 7/0027 16/248

FOREIGN PATENT DOCUMENTS

DE 2 055 217 A2 5/2009
DE 20 2008 018 637 U1 1/2017
EP 0 330 973 A2 9/1989
JP 2006161361 A * 6/2006

* cited by examiner

HINGE AND CABINET PROVIDED WITH A HINGE

CROSS REFERENCE TO RELATED APPLICATIONS

This application is a continuation under 35 U.S.C. § 371 of International Application No. PCT/NL2018/050743 filed on Nov. 7, 2018 which claims priority to Dutch Patent Application No. NL2019859 filed Nov. 7, 2017, which is hereby incorporated by reference herein in its entirety.

The present invention relates to a hinge for a rotating panel, in particular a transparent panel, comprising a first hinge part for attaching close to the panel and a second hinge part for attaching to the panel, wherein a receivable member extends from a one of the two hinge parts and is received in a receiving cavity in another of the two hinge parts in order to connect the two hinge parts pivotally to each other.

Such hinges are applied on a large scale for furnishings, and in particular for refrigerated cabinets, wherein the panel comprises a glass door or plastic door. Such refrigerated cabinets are applied on large scale, for instance in supermarkets and other retail trade, to display refrigerated and frozen goods. The panel is held here on an edge part in the second hinge part of the hinge and is received pivotally by the first hinge part. This first hinge part will normally be connected fixedly to a wall or panel frame of the furnishing.

For an optimal view through the glass door or plastic door of a space behind, and also from an aesthetic viewpoint, a contact surface between the panel and the hinge, as with possible other mountings, attachments or hanging and closing fittings, is preferably as small as possible. This does however mean that mechanical stresses will be concentrated on a relatively small surface during pivoting of the panel. It is moreover necessary with a refrigerated cabinet to make allowance for stresses of thermal origin resulting from the difference between an inner climate and outer climate of the furnishing. Practical experience shows that such stresses can eventually result in breakage of or adverse effects on a glass door or plastic door.

The present invention has for its object, among others, to provide a hinge and furnishing with which such adverse effects or damage are prevented.

In order to achieve the stated object a hinge of the type described in the preamble has the feature according to the invention that an individual holder body is accommodated while allowing freedom of movement in the receiving cavity, that the holder body comprises a bore, and that the receiving member is received in the bore of the holder body. A furnishing, in particular a refrigerated cabinet, with a space closable by a rotatable panel has the feature here according to the invention that the panel is suspended via at least one such hinge according to the present invention. The receivable member is received here in a holder body which has a certain freedom of movement inside the other hinge part in order to be able to accommodate possible mechanical stresses instead of transmitting them to the panel. Breakage or other adverse effect on the panel resulting in practice from such stresses can hereby be effectively prevented.

The hinge according to the invention is highly suitable for application with glass doors and/or plastic panels which generally have a limited capability to cope with mechanical stresses. A particular embodiment of the furnishing according to the invention is therefore characterized in that the panel comprises a glass door or plastic door, in particular a transparent or at least translucent plastic door, and more particularly that the panel is pivotable about a vertical pivot axis and is mounted rotatably at a top side and bottom side via a set of hinges according to the present invention.

In a preferred embodiment the hinge is characterized according to the invention in that the holder body is at least substantially spherical and is received fittingly in the receiving cavity so as to form a ball joint therewith. Because a ball joint is formed here, the holder body will be able to absorb and accommodate stresses from different directions without problem by always orienting itself in an optimal direction substantially free of stress.

A further preferred embodiment of the hinge according to the invention is characterized in that the bore comprises a screw cavity and that the receivable member comprises a complementary screw member which is received in the screw cavity. Because of the interaction between the receivable screw member and the screw cavity adapted thereto the panel can take a self-closing form. A particular embodiment of the furnishing according to the invention is therefore advantageously characterized in that the panel comprises close to at least one of the top side and bottom side a hinge with a receivable member comprising a screw member which is received in an at least substantially complementary screw cavity. In the case of an upward directed screw member the panel automatically rotates counter to the pitch of the screw under the influence of gravitational force, while in the case of a downward directed screw member the same self-closing effect is obtained in the pitch direction. A particular embodiment of a furnishing in which this is applied is therefore characterized according to the invention in that the panel comprises the hinge at least close to the underside, wherein the screw member extends from the first hinge part and the second hinge part comprises the screw cavity, and that the panel swings open counter to a pitch of the screw member in order to provide access to the space.

In a practical application a further particular embodiment of the hinge according to the invention has the feature that the receivable member extends non-rotatably from the first hinge part and the second hinge part comprises the receiving cavity with the holder body therein. The receiving cavity is thus situated wholly inside the hinge and a cavity need not be recessed into a frame or wall around the panel. The hinge can thus be embodied wholly as surface-mounted fitting, this providing a significant advantage in assembly.

For a mounting of the hinge on the panel which is both attractive and effective, a further preferred embodiment of the hinge according to the invention has the feature that the second hinge part comprises a set of mutually connectable clamping parts which are intended and configured to receive an edge part of the panel therebetween. The clamping parts form a seat here into which the edge part of the panel drops, wherein the panel can for instance be clamped fixedly in the seat by means of one or more bolts between the clamping parts.

From a viewpoint of cost a further particular embodiment of the hinge according to the invention is characterized in that the first hinge part and the second hinge part are formed at least substantially from plastic.

The invention will be further elucidated hereinbelow with reference to an exemplary embodiment and an accompanying drawing. In the drawing.

It is otherwise noted here that the figures are purely schematic and not always drawn to (the same) scale. Some dimensions in particular may be exaggerated to greater or lesser extent for the sake of clarity. Corresponding parts are designated in the figures with the same reference numeral.

Figure 1:
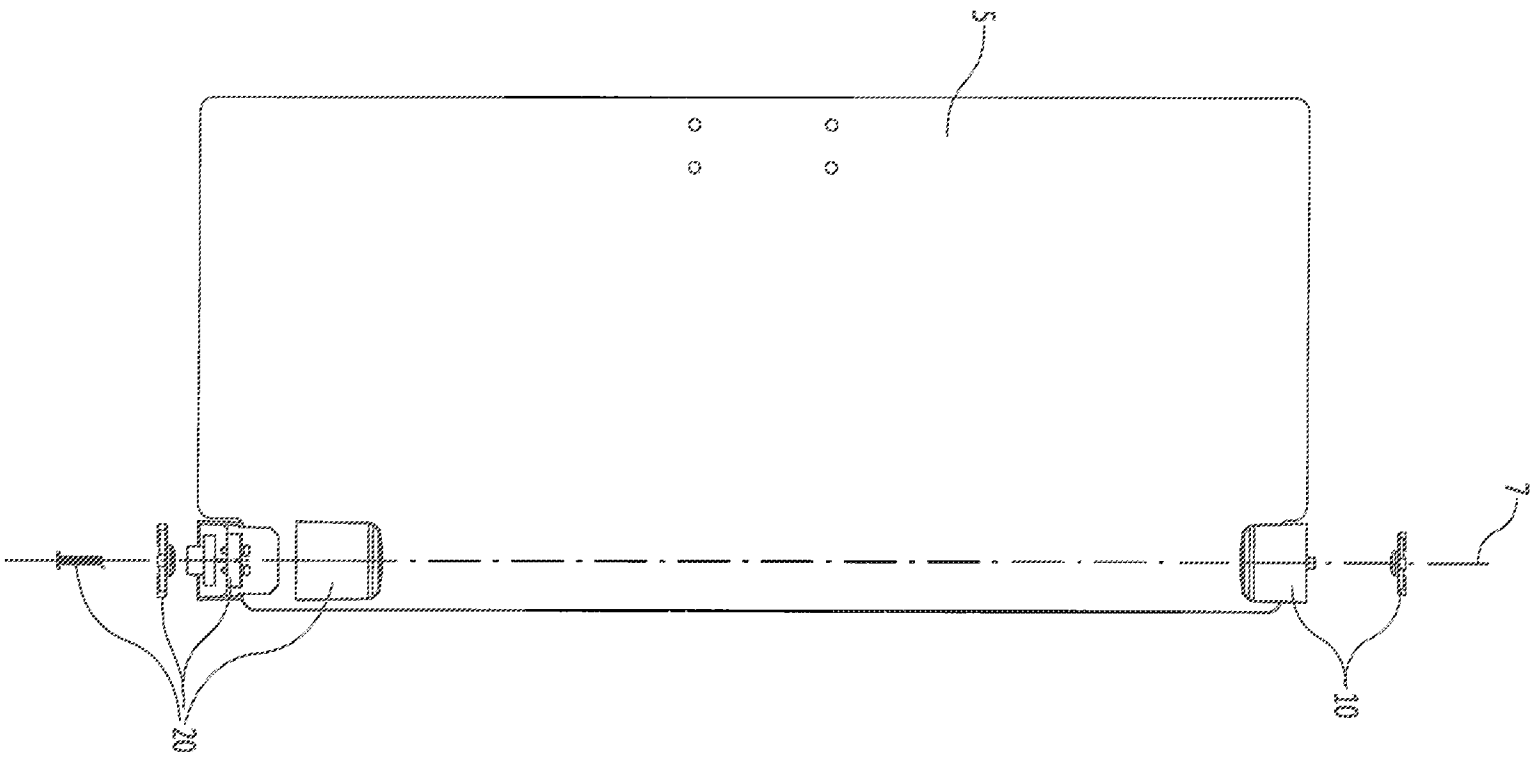
FIG. 1 shows an exemplary embodiment of a panel according to the invention.

FIG. 1 shows a refrigeration door 5 for a refrigerated cabinet lying behind. Door 5 opens up one or more shelves of the refrigerated cabinet in which refrigerated and/or frozen goods are displayed. Such a refrigeration door normally takes a transparent form so as to provide the most unobstructed possible view of the shelves lying behind. These refrigerated cabinets are usually applied in the retail trade and in other sales channels to display refrigerated and frozen goods which are thus visible to the customer from outside but are nevertheless accommodated in a considerably cooler climate. Applied for door 5 is glass or, as in the present example, a plastic panel of double-walled polymethyl methacrylate (PMMA), also referred to as acrylate (glass) or perspex®. The double-walled construction of the panel is manifested in a cavity and provides an extremely good thermal insulation of the space behind.

Figure 2:
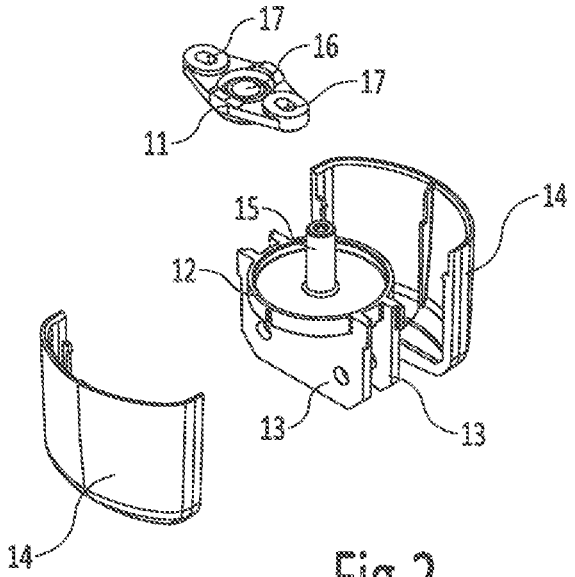
FIG. 2 is an exploded view of a first hinge for suspending the panel of FIG. 1.
Figure 3:
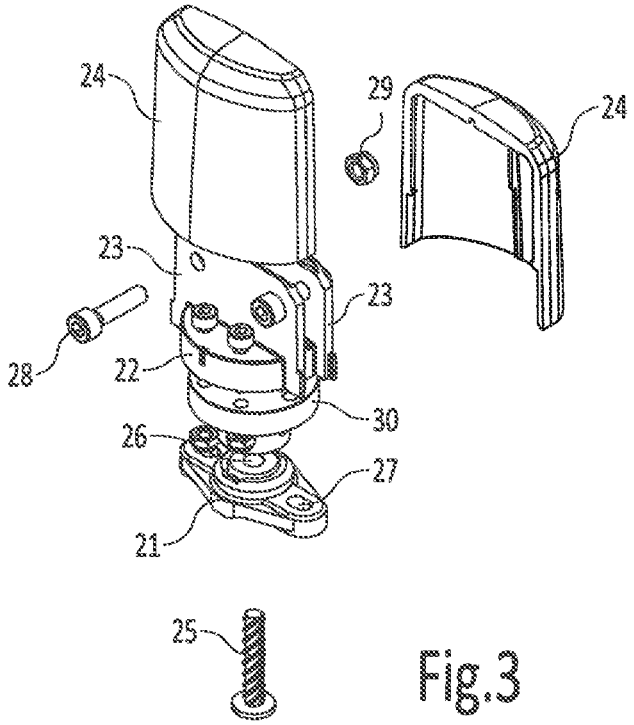
FIG. 3 is an exploded view of a second hinge for suspending the panel of FIG. 1.

The panel is suspended for pivoting about a pivot axis 7 in a frame or casing, which for the sake of clarity is not shown in the figure but is assumed sufficiently known to a person with ordinary skill in the art. Serving for this purpose are a first hinge 10 on a top side in combination with a second hinge 20 on a bottom side of panel 5 which together define the pivot axis 7. Each hinge 10,20 here comprises a first hinge part 11,21 for attachment to or close to an edge of the opening in which the panel is suspended. This part provides for this purpose a set of screw openings 17,27, see FIGS. 2 and 3, for receiving a corresponding set of screw members arranged in the edge.

Each hinge 10,20 comprises in addition a second hinge part 12,22 for attachment to panel 5. The panel is received here with an edge part between a set of clamping parts 13,23 which extend from second hinge part 12,22 and which together form a fork or seat in which the panel can be fixed with a set of through-bolts 28,29. This panel attachment is concealed from view by a set of shell parts 14,24 which slide over clamping parts 13, 23.

For both the first 11,21 and the second hinge part 12,22 of both hinges 10,20 it is the case that the components thereof are all formed substantially from a suitable plastic such as ABS, polystyrene or polypropylene, although one or more of these parts can if desired also be manufactured from metal. Shell parts 14,24 will normally always be embodied as plastic parts, while for strength purposes metal, preferably stainless steel (SS), screw bolts and nuts 28,29 are normally applied.

For the purpose of a pivoting connection the first hinge 10 comprises in first hinge part 11 a receiving cavity 16 which continues into an edge of the opening lying behind in which and through which is received a receivable member 15 which extends from second hinge part 12. Receivable member 15 comprises a pivot pin which is formed as integral component on second hinge part 12 and which protrudes with a small clearance into cavity 16. The first hinge thus allows free pivoting of panel 5 around pivot axis 7 once the two parts 11,12 have thus been joined to each other and mutually connected. Pivot pin 15 can if desired be formed mutatis mutandis on first hinge part 11 and the receiving cavity can be provided in second hinge part 12.

Both hinge parts 21,22 of second hinge 20 are also mutually connected for pivoting relative to each other. First hinge part 21 thereof comprises for this purpose a receivable member 25 which thus extends from an edge of the opening, while the second hinge part comprises a corresponding receiving cavity 35 in which receivable member 25 is received for pivoting about pivot axis 7. Receivable member 25 in this case comprises a screw member with an external screw thread, while the receiving cavity comprises a screw cavity 35 with a complementary internal screw thread. Screw member 25 is embodied here as separate body which protrudes through an opening 26 provided for the purpose, but can optionally also extend as integral part from first hinge part 21.

Figure 4:
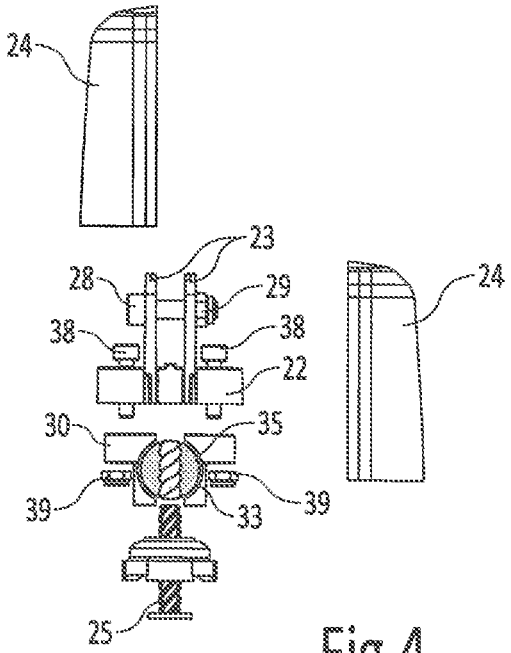
FIG. 4 shows a cross-section of the hinge of FIG. 3.

According to the present invention at least one of the two hinges comprises in the hinge part comprising the receiving cavity a holder body 33 which is received therein while allowing freedom of movement and which comprises a bore for receiving the receiving member therein. In this example this is the case for the second hinge 20 shown here, see also FIG. 4. The second hinge part 22 thereof comprises a holder part 30 in which a ball body 33 is thus enclosed with a small clearance and with an omnidirectional freedom of movement. This holder part 30 is connected by means of four bolts 38 and nuts 39 in second hinge part 22 and comprises two separate half parts which enclose ball body 33. The bore extending through ball body 33 comprises a screw cavity 35 here with an internal winding complementary to an external screw thread with which the screw member 25 receivable therein is provided.

Screw cavity 35 extends in and through this ball body 33 in order to receive screw member 25 therein. The own freedom of movement of ball body 33 allows hinge 20 to align itself to possible mechanical deformations between the edge of the refrigerated cabinet and the panel and to thus effectively accommodate and absorb other mechanical stresses which occur. This results in a significant improvement in the lifespan and reliability of the hinge.

Because in this case the receivable member and the bore in the holder body are each embodied with a screw thread and are thereby in mutual engagement, when panel 5 swings open the panel 5 will rise to some extent over the screw thread and, when released, drop downward again counter to the screw thread back to the closed starting position under the influence of gravitational force. A self-closing effect of the panel is thus obtained. Receiving cavity 16 of first hinge 10 provides sufficient space to accommodate this movement. A similar screw mechanism can optionally also be provided therein and a holder part can optionally also be applied therein with a holder body which is received while allowing freedom of movement therein and which comprises the receiving cavity.

Although the invention has been further elucidated above with reference to only a single exemplary embodiment, it will be apparent that the invention is by no means limited thereto. On the contrary, many variations and embodiments are still possible within the scope of the invention for a person with ordinary skill in the art.

We claim:

1. A hinge for a rotating panel, comprising a first hinge part for attaching close to the panel and a second hinge part for attaching to the panel, wherein one of the two hinge parts comprises a receiving cavity, wherein an individual holder body is accommodated in said receiving cavity of said one of said two hinge parts, wherein said holder body lies with a freedom of movement within said receiving cavity, wherein said holder body comprises a bore, wherein a receivable member extends from another of the two hinge parts, wherein said receivable member is received in said bore of said holder body, and wherein said holder body thereby intervenes between said receivable member and said receiving cavity to thereby connect the two hinge parts pivotally to each other.

2. The hinge according to claim 1, wherein the holder body is at least substantially spherical and is received fittingly in the receiving cavity so as to form a ball joint therewith.

3. The hinge according to claim 1, wherein the bore comprises a screw cavity and that the receivable member comprises a complementary screw member which is received in the screw cavity.

4. The hinge according to claim 1, wherein the receivable member extends non-rotatably from the first hinge part and the second hinge part comprises the receiving cavity with the holder body therein.

5. The hinge according to claim 1, wherein the second hinge part comprises a set of mutually connectable clamping parts which are intended and configured to fixedly clamp an edge part of the panel there between.

6. The hinge according to claim 1, wherein the first hinge part and the second hinge part are formed at least substantially from plastic.

7. A furnishing, with a space closable by a rotatable panel, wherein the panel is suspended in the furnishing via at least one hinge according to claim 1.

8. The furnishing according to claim 7, wherein the panel comprises a glass door or plastic door.

9. The furnishing according to claim 7, wherein the panel is pivotable about a vertical pivot axis and is mounted rotatably at a top side and bottom side via the set of hinges.

10. The furnishing according to claim 9, wherein the panel further comprises a hinge with a receivable member comprising a screw member which is received in an at least substantially complementary screw cavity.

11. The furnishing according to claim 10, wherein the panel comprises the hinge at least close to the underside, wherein the screw member extends from the first hinge part and the second hinge part comprises the screw cavity, and that the panel swings open counter to a pitch of the screw member in order to provide access to the space.

12. The furnishing according to claim 7, wherein said space is a refrigerated space in a refrigerated cabinet.

13. The furnishing according to claim 12, wherein said panel is a transparent or at least translucent panel.

14. The furnishing according to claim 13, wherein said panel is a plastic panel.

* * * * *